United States Patent [19]

Panahpour

[11] Patent Number: 4,796,616

[45] Date of Patent: Jan. 10, 1989

[54] MASSAGING DEVICE

[76] Inventor: Yousef Panahpour, 1980 Post Oak Blvd., Suite 1015, Houston, Tex. 77056

[21] Appl. No.: 90,955

[22] Filed: Aug. 28, 1987

[51] Int. Cl.[4] ..... A61H 15/00

[52] U.S. Cl. ..... 128/57; 128/62 R

[58] Field of Search ..... 128/46, 45, 57, 62 R, 128/44, 156, 67, 24.3, 24.4, 49

[56] References Cited

U.S. PATENT DOCUMENTS

| | | | |
|---|---|---|---|
| 1,070,924 | 8/1913 | Schulze | 128/57 |
| 1,239,539 | 11/1917 | Swenson | 128/57 |
| 1,886,544 | 11/1932 | Hemp | 128/57 |
| 2,988,084 | 6/1961 | Douglas | 128/57 |
| 4,169,466 | 10/1979 | Wong | 128/57 |
| 4,374,519 | 2/1983 | Stauft | 128/57 |

FOREIGN PATENT DOCUMENTS

| | | | |
|---|---|---|---|
| 1169036 | 12/1958 | France | 128/57 |
| 0618413 | 3/1961 | Italy | 128/57 |
| 0011966 | 3/1916 | United Kingdom | 128/57 |

*Primary Examiner*—David A. Wiecking
*Assistant Examiner*—Huong Q. Pham
*Attorney, Agent, or Firm*—Pravel, Gambrell, Hewitt, Kimball & Krieger

[57] ABSTRACT

A massaging apparatus having a plurality of balls mounted in laterally and longitudinally spaced openings in a carrier, wherein the balls are made of a yieldable, compressible material and are positioned in the openings so that a portion of each ball projects beyond the generally planar plates of the carrier, and the balls are mounted so as to enable the balls to be compressed and freely rotated in all directions when one projecting ball portion is in contact with a user's body and the other projecting ball portion is in contact with the floor or other relatively rigid surface.

5 Claims, 1 Drawing Sheet

MASSAGING DEVICE

BACKGROUND OF THE INVENTION

This invention relates to a new and improved massaging device having a series of balls mounted in a carrier.

It is well known that a massaging effect can be obtained by moving a series or group of balls relative to parts of a user's body. Examples of prior art devices of that type are shown in U.S. Pat. Nos. 2,895,469; 3,060,928; 3,081,768; 3,542,016; 4,169,466; 4,374,519; 4,577,625; and 4,603,688.

So far as is known, the approach of the prior art devices has been to provide basically hard, non-yielding balls in such devices, except for the device shown in U.S. Pat. No. 4,374,519. That device mounts the yieldable balls on shafts which restrict the movements and compressibility of the bals as compared to balls mounted for free rotation in all directions in a carrier.

SUMMARY OF THE INVENTION

The present invention provides a massaing device which more fully utilizes the compressibility or yieldability of massaging balls by mounting them so that they are not only compressible but are also freely rotatable in all directions in openings in a carrier even when in the compressed condition in which they become distorted towards a flattened or elliptical shape in the openings.

DETAILED DESCRIPTION OF THE INVENTION

Figure 4:
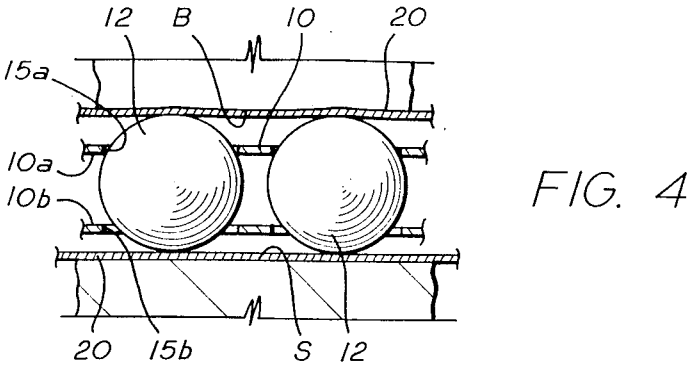
FIG. 4 is an enlarged view of a portion of the massaging device of FIG. 1, illustrating the position of one of the balls in the carrier prior to any compression of the balls.

In the drawings, the letter A designates generally the carrier of this invention.

The carrier A, in the preferred embodiment, includes a carrier body 10 which has generally planar, substantially parallel plates indicated as a first plate 10*a* and a second plate 10*b*. On each side of the central portion of the carrier body 10 are preferably side portions or extensions 10*c*, each of which has a first inclined or tapered plate 10*d* which is inclined towards an extension of the second plate 10*b*, the purpose of which will be hereinafter explained. The plates 10*a* and 10*b* are joined together in a spaced-apart relationshp by support. ribs 10*g*. Likewise, the lates 10*d* and 10*b* are joined together by end ribs 10*f*.

The central portion of the carrier body 10 is defined by the ridges or corners 10*e* at each side of the plate 10*a*. In some instances, only the central portion between the ridges or corners 10*e* where the surfaces 10*a* and 10*b* are substantially paralle to each other, may be utilized rather than including the side portions 10*c*.

Considering first th central portion of the carrier body 10, it can be seen that such carrier body 10 has a plurality of holes or openings 15 in each of the plates 10*a* and 10*b*, each of which is adapted to receive a ball 12. Each ball 12 is made of a yieldable elastic material, and is preferably hollow of that it is compressible and will distort from a ball or spherical shape to a compressed or flattened egg-shape when compression forces are applied thereto. A tpical ball would be the type used. for playing tennis and therefore the ball itself would be made of rubber or a similar elastic material which is preferably hollow in the center.

As best seen in FIG. 4, each of the openings 15 preferably has a circular diameter 15*a* in plate 10*a* and the same or similar diametr 15*b* in the second plate 10*b*.

Preferably, the opening diameters 15*a* and 15*b* are slightly smaller than the diameter of each ball 12, but are large enough so that here is little or no frictional contact with the balls 12. Such construction allows the balls 12 to rotate in the carrier 10 freely, while also confining them so that thy are not inadvertently dropped out of the openings 15.

In some cases, for making the contact with the user more comfortable, this invention may optionally have a sheath 20 made of flexible material such as fabric or cloth made of nylon or and other suitable relatively soft material which preferably extends entirely around the carrier A and all of the balls mounted therewith. The sheath 20 provides a smooter surface than the balls 12 by bridging between the ba-ls 12. For purposes of illustration, the sheath 20 has been omitted from FIGS. 4 and 5, since the massagin- device of this invention does not require the use of th sheath. For the sheath 20 to move freely during movemet of the device without interfering with the compresson of the balls 12 and 14, preferably a roller 30 is mounted on a shaft 31 supported by brackets 32 at each end of the carrier.

In addition to the blls 12, which are all of the same or substantially the same diameter, and all of which fit within the central portion of the carrier body 10, this invention may optionally have a plurality of openings 18 in each of the plates 10*d* and 10*b* which form the side portions 10*c*, each of whih is adapted to receive a ball 14 which is of a smaller diameter than the balls 12. However, the general relaionship of the balls 14 to the openings 18 is the same as heretofore described and as hereinafter explained witn respect to the balls 12 in the openings 15.

It should be noted hat the distance between the first plate 10*a* and the s-oond plate 10*b* is less than the diameter of each of the balls 12. Similarly, the distance from the inclined plate 10*d* to the extension of the lower or second plate 10*b* is liewise less than the diameter of the balls 14.

In the use of the masaging device of this invention, it is important that the balls 12 and 14 be freely rotatable in all directios at all times, whether in the normal uncompressed state or in the compressed state during use. As can be seen from a comparison of FIGS. 4 and 5, the normal state o each ball 12 and 14 is in the spherical uncompressed condition so that it may be rolled on a surface S such as the floor or a wall or the back of a chair or any other simlar relatively rigid surface. During such rolling, with one portion of each of the balls in contact with such surfce S and the other side of the balls in contact with a body surface B, such as a person's back or other part of the body, the balls 12 and 14 may be moved back and forth in any direction without any compression and they will freely rotate in each of the openings 15 and 18, respectively. Such type of minimal contact with the surface B of the user may provide a minimal stimulation or masaging action even without any compression of the balls 12 and 14. If the side extensions 10c are used, the tapered end portions 10c of the carrier A allow for a contoured movement to adjust to various parts of the body of the user during the rolling action of the balls over the person's body.

Figure 5:
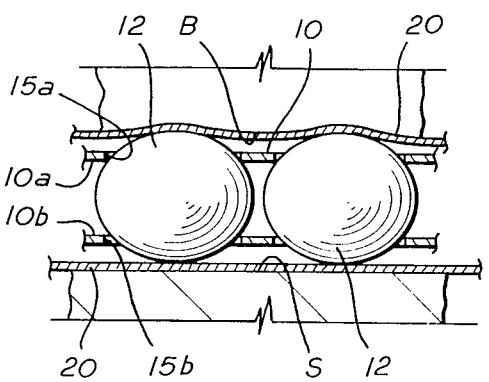
FIG. 5 is a view similar to FIG. 4, but showing one of the balls in a compressed condition during the massaging action with the massaging device of this invention.
Figure 3:
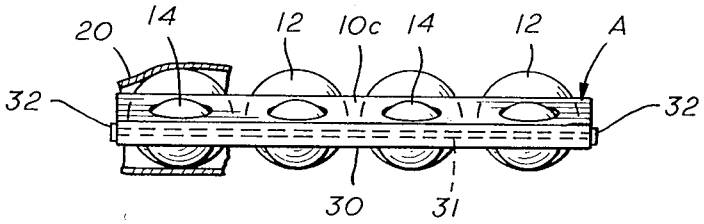
FIG. 3 is an end view of the massaging device of this invention taken from either end of FIG. 1, and showing only a portion of the sheath therewith.
Figure 1:
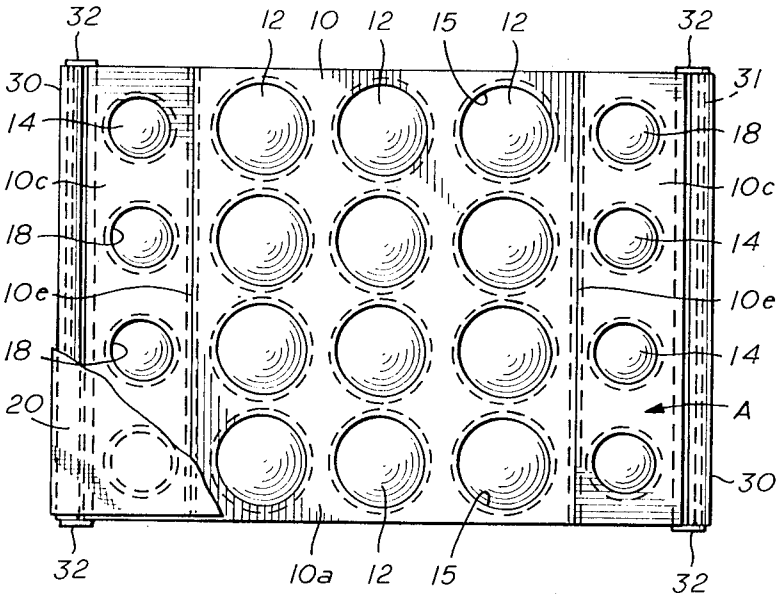
FIG. 1 is a plan view of the massaging device of this invention, with a portion of the external sheath removed.
Figure 2:
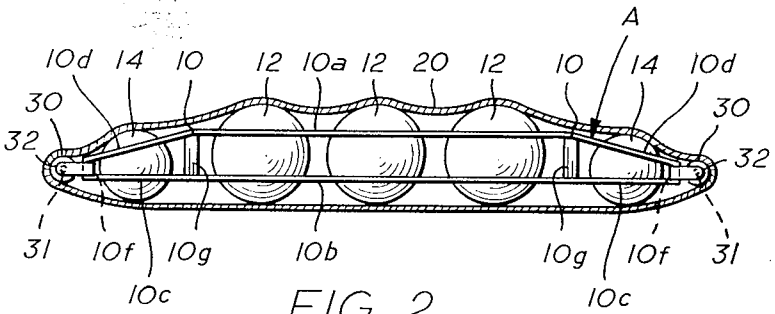
FIG. 2 is an elevation of the massaging device of this invention, illustrating the invention with a sheath enclosing the structure.

When it is desired to apply a more vigorous massaging on the person's body, the user presses his or her body against the balls 12 so s to compress the balls 12 against the relatively rigi-d surface S as shown in FIG. 5. The balls 12 are thus coressed gradually towards a flattened, elliptical or an egg shape as shown in FIG. 5. It is to be noted that the balls 12 are spaced sufficiently from the nex adjacent balls 12 wh.en in the uncompressed condition so that each ball 12 may be compressed to some extent before contacting the adjacent balls 12; however, such .ontact, if any, should not create frictional resistace that would prevent rotation of the balls 12 in the compressed condition. Such compression and rotation f the balls in the compressed state produces a much greater massaging effect than when the balls are in the uncom-ressed state, while at the same time providing yieldabilit on the surface B of the user's body so that that there is a massaging action more nearly like the hands of a prson rather than the non-yieldability of a hard non-oompressible ball. The balls 14 are similarly positioned relative to eaoh other.

Upon release of the compressive force between the body surface B and the rlatively rigid surface S, the balls 12 and 14, because of their elasticity, return to their normal uncompressed condition shown in FIG. 4. Thus, the use of the massaging device of this invention may be repeated and applied to different parts of the user's body.

It can be appreciatd that the device of this invention is particularly adapted for use by an individual without assistance from a-other person and is especially adapted for massaging acton on the back by positioning the device on the floor svo that the person may lie in a supine position on the de ice so as to move relative to the devioe to thereby oreate the oompression and rotation of the balls, and the res,ltant massaging action on the user's back or other parts. The device may also be positioned on the back of a chair so that a person in a seated position may move nis back up and down, sideways, and diagonally relative to the device to obtain the massaging action.

If desired, the device may be positioned on a wall at the appropriate height for a user to rub his or her back against the balls 12 In addition to massaging the back, by placing the device on the floor, a person may massage his or her feet b- moving the bottom of each foot over the balls 12 which aplying a compressive force to the balls 12 with the foot.

The device of this nvention may be mechanically moved laterally, longitud.nally, or diagonally, that is, in all directions, relatie to the user's body with any known mechanical device, so that the person may remain stationary while the device is moved.

As previously noted, only the central portion of the massaging device may be ployed, thus eliminating the balls 14 and the side carrier extensions 10c.

The foregoing discloure and description of the invention are illustrativ and explanatory thereof, and various changes in the size, shape and materials, as well as in the details of the illustrated construction may be made without departing fro. the spirit of the invention.

I claim:

1. A massaging apparatus, comprising:

a plurality of elastic spherical massaging balls which are yieldable and compressible from a spherical shape to a substantially elliptical shape upon applying a compressive force thereto;

a carrier for said balls having sides a generally planar first plate and a generally planar second plate;

each of said plates having an opening through said plates with a substantially circular edge for mounting each of said balls between said plates in order to permit rotation of said balls relative to said plates whether in a non-compressed or compressed condition;

the distance between said first plate and said second plate being less than the diameter of each of said balls so that a portion of each of said balls projects externally of each said opening beyond both said first plate and said second plate;

each of said balls when in a non-compressed condition being laterally and longitudinally spaced from each adjacent ball a sufficient distance to enable each of said balls to be compressed to a substantially eliptical shape without contacting the adjacent ball and being rotatable relative to said carrier while so compressed; and the opening for each of said balls having a diameter which is slightly smaller than the diameter of each ball and large enough so that there is very little frictional contact between the edge of said opening and the ball when the ball is in the non-compressed condition so as to allow the balls to freely rotate in all directions at all times and so that upon compression of each ball to a substantially elliptical shape, each ball can still be rotated relative to said plates of said carrier.

2. The apparatus set forth in claims 1, wherein:

the portion of each of said balls projecting from said first plate is adapted to be contacted with the body of a user to effect the compression of the balls and the rotation of the balls relative to the carrier.

3. The apparatus of claim 1, wherein:

the portion of each of said balls projecting from said first plate is adapted to be contacted with the body of a user to effect the compression of the balls and the rotation of the balls relative to the carrier; and the portion of said balls projecting from said second plate is adapted to be contacted by a relatively rigid surface to facilitate the compression of the balls during the massaging of the body of the user.

4. The apparatus of claim 1, including:

side extensions on each side of said carrier body comprising a first extensions which extend laterally from said first plate and a second extensions which extend laterally from said second plate;

said first extensions being inclined relative to said first plate in a direction towards said second extensions;

a plurality of smaller balls each having a diameter smaller than said massaging balls; and each of said extensions has openings therethrough, each of which is adapted to receive and confine one of said smaller balls.

5. The apparatus of claim 1, wherein:

each of said balls has a hollow center.

* * * * *